United States Patent [19]

Cookson

[11] 3,951,084

[45] Apr. 20, 1976

[54] MANUFACTURE OF A FRANGIBLE ELEMENT IN SHEET MATERIAL

[75] Inventor: William Cookson, Fareham, England

[73] Assignee: Cookson Sheet Metal Developments Limited, Southampton, England

[22] Filed: Sept. 20, 1974

[21] Appl. No.: 507,669

Related U.S. Application Data

[63] Continuation of Ser. No. 395,252, Sept. 7, 1973, abandoned, which is a continuation of Ser. No. 156,295, June 24, 1971, abandoned, which is a continuation-in-part of Ser. Nos. 796,975, Feb. 6, 1969, abandoned, and Ser. No. 28,880, April 15, 1970, abandoned. Said Ser. No. 28,880 being a continuation-in-part of said Ser. No. 796,975.

[30] Foreign Application Priority Data

| | | |
|---|---|---|
| Mar. 16, 1968 | United Kingdom | 7698/68 |
| Jan. 24, 1969 | United Kingdom | 4248/69 |
| Nov. 26, 1970 | United Kingdom | 56335/70 |
| June 15, 1971 | United Kingdom | 28024/71 |
| Jan. 15, 1970 | Ireland | 58/70 |

[52] U.S. Cl. ..... 113/121 C; 113/1 F; 113/15 A

[51] Int. Cl.[2] ..... B21D 51/26

[58] Field of Search ..... 113/15 R, 15 A, 121 C, 113/1 F; 220/264, 270, 276

[56] References Cited

UNITED STATES PATENTS

| | | | |
|---|---|---|---|
| 2,071,030 | 2/1937 | Fay | 220/48 |
| 2,112,231 | 3/1938 | Speidel | 113/15 R |
| 3,254,790 | 6/1966 | Dunn | 220/54 |
| 3,303,958 | 2/1967 | Taylor | 220/54 |
| 3,334,777 | 8/1967 | Smyth | 113/121 C |
| 3,362,569 | 1/1968 | Geiger | 220/48 |
| 3,400,852 | 9/1968 | Khoury | 220/54 |
| 3,411,470 | 11/1968 | Fraze | 113/121 C |
| 3,434,623 | 3/1969 | Cookson | 220/54 |
| 3,500,939 | 3/1970 | Bozek | 113/121 C |
| 3,698,590 | 10/1972 | Cookson | 220/54 |

*Primary Examiner*—C. W. Lanham
*Assistant Examiner*—Gene P. Crosby
*Attorney, Agent, or Firm*—Merriam, Marshall, Shapiro & Klose

[57] ABSTRACT

A disclosure of making a frangible element or weakened line in metal sheet, especially tinplate, for use as a container end, an elongate frangible element of thinned metal is produced in the sheet, bounded on one side by a step in one surface and on the other side by a step in the other surface, the two steps as seen in section merging smoothly with concave curves into the respective surfaces of the frangible element. To take up excess metal from the thinning process, at least one hollow protuberance is formed in the sheet to one side of the frangible element. Press tool dies for performing the method are shown.

16 Claims, 15 Drawing Figures

FIGS 1 AND 2 ILLUSTRATE THE PRIOR ART.
Fig. 1.
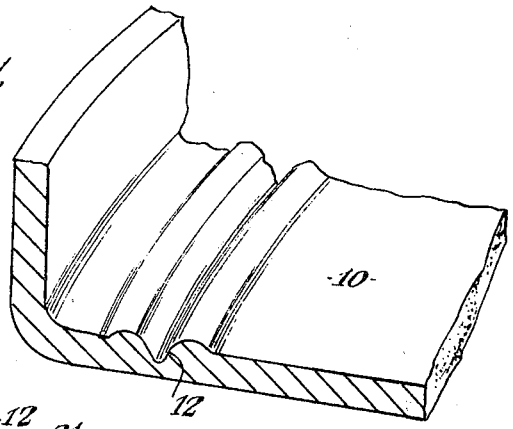
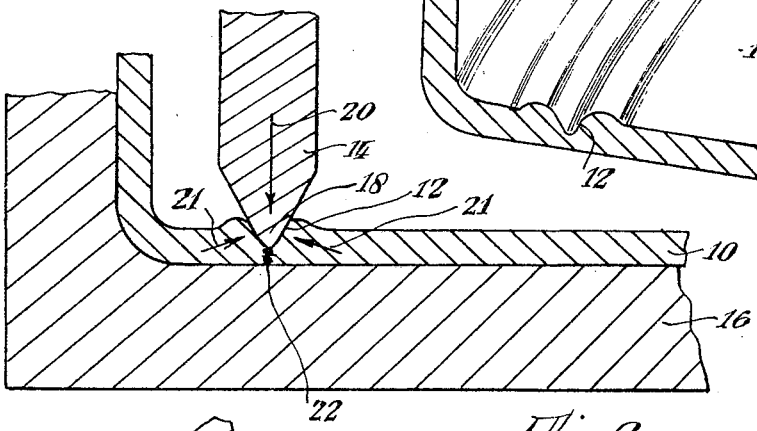
Fig. 2.
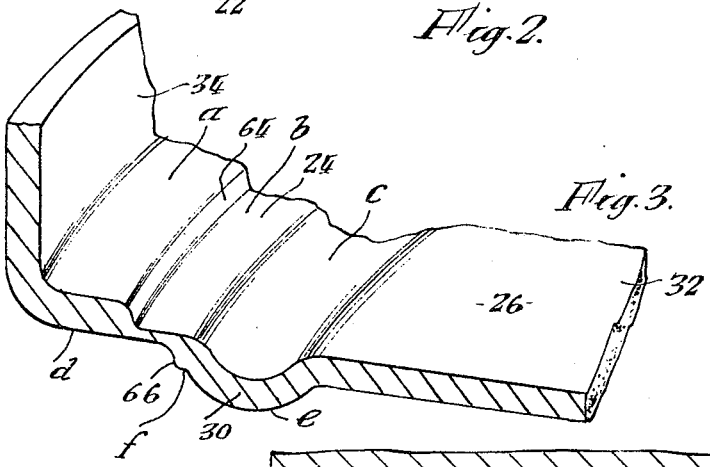
Fig. 3.
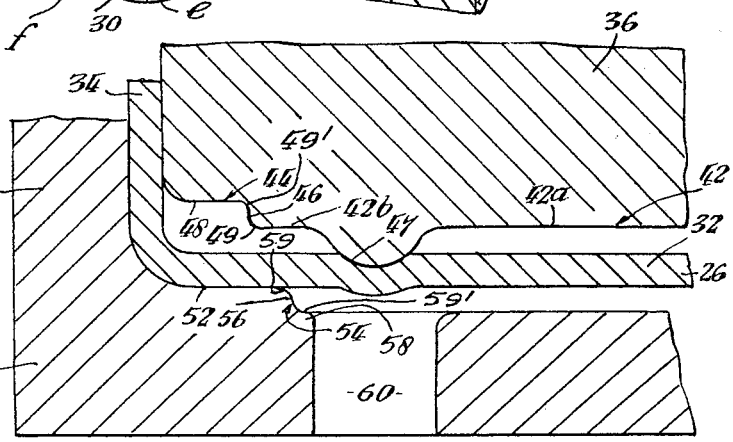
Fig. 4.

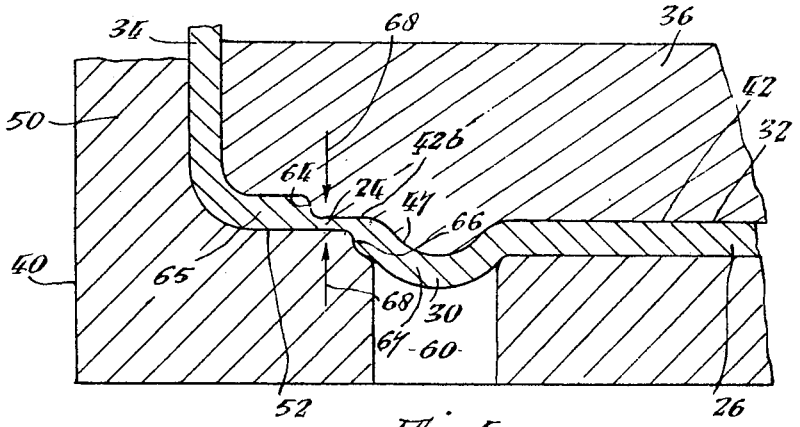
Fig. 5.
Fig. 6.
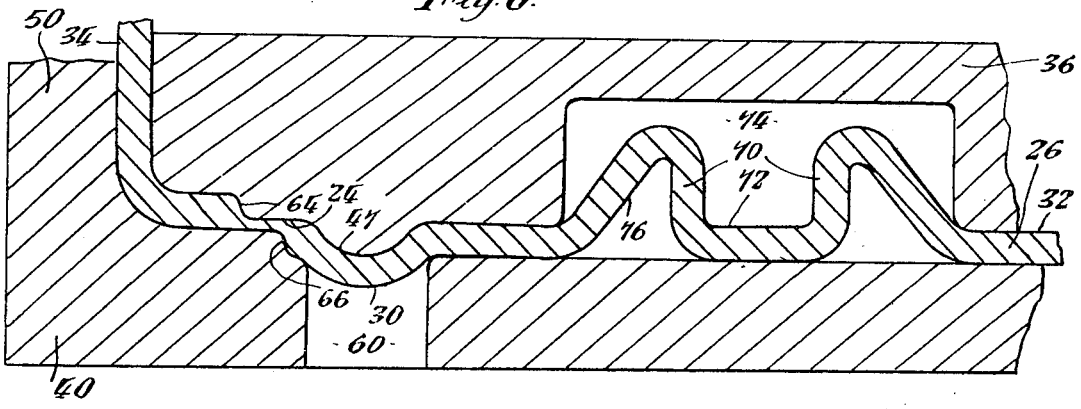
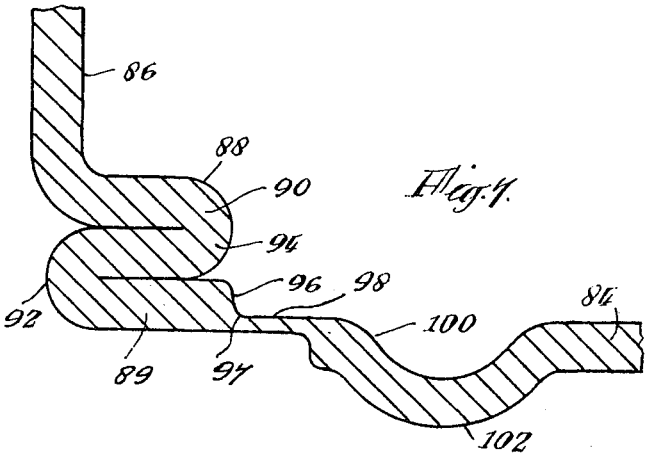
Fig. 7.

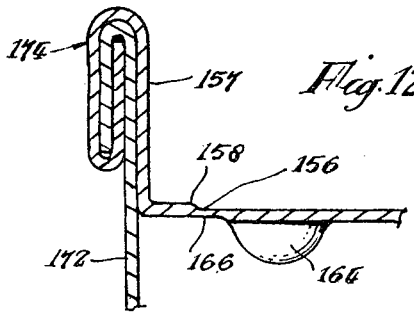
Fig. 12.
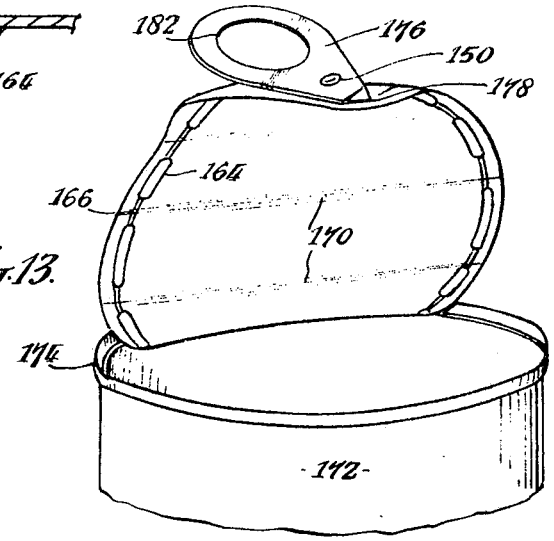
Fig. 13.
Fig. 15.
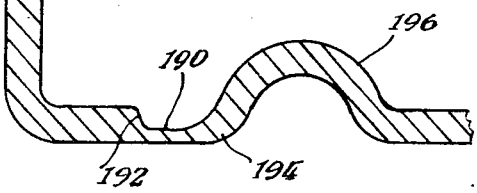
Fig. 14.
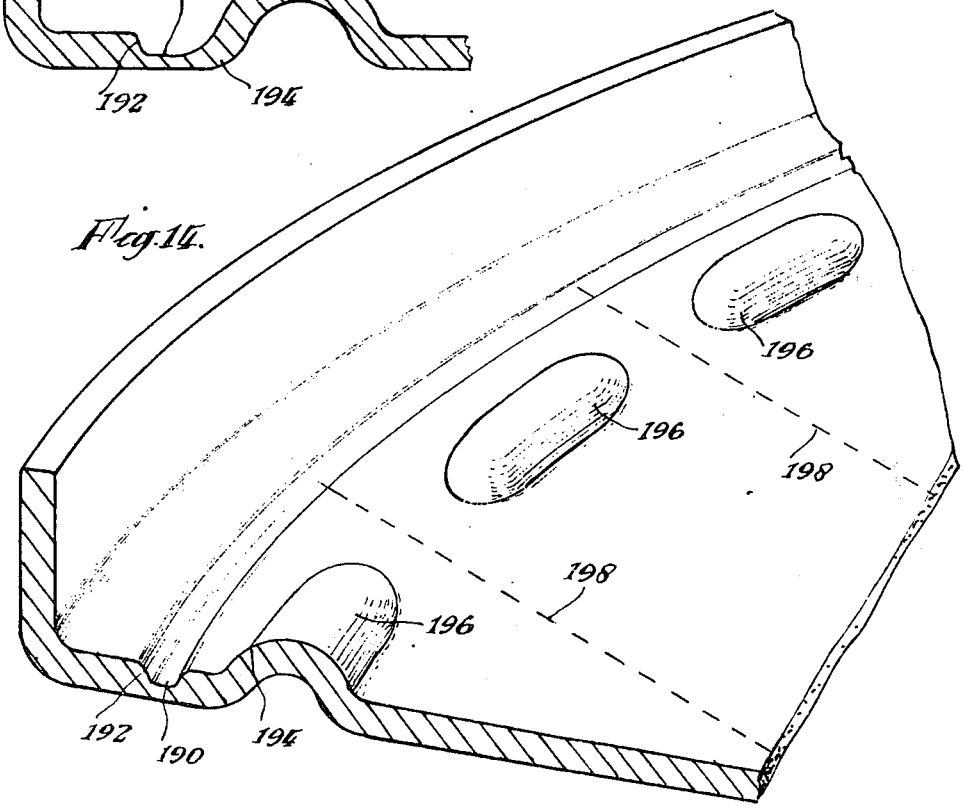

MANUFACTURE OF A FRANGIBLE ELEMENT IN SHEET MATERIAL

This is a continuation of co-pending application Ser. No. 395,252, filed Sept. 7, 1973, and now abandoned, which was a continuation of now-abandoned application Ser. No. 156,295, which was filed June 24, 1971 as a continuation-in-part of applications Ser. No. 796,975, filed Feb. 6, 1969, and 28,880, filed Apr. 15, 1970, both now abandoned. Application Ser. No. 28,880 was itself a continuation-in-part of application Ser. No. 796,975.

This invention relates to a method and apparatus for making a weakened line in sheet material, especially in thin sheet material and particularly metal sheet having a thin outer layer of surfacing material, which will usually be a protective material, for instance tinplate (tin-coated steel) or other plated metal. It is particularly applicable to the manufacture of container walls made of thin sheet material, for example tinplate, in which a portion of the material bordered by a weakened line is torn by hand out of the material.

It is usual practice to provide a weakened line in sheet metal by scoring, that is by pressing a top die having a sharpened edge on to a flat bottom die to partially cut through the sheet metal to leave a residual of metal of about 30% of the original thickness of the material.

As the displaced metal flows from each side of the scoring tool it forms inclined surfaces in the top portion of the metal causing compression stresses which are unbalanced between the top and bottom surfaces of the metal. In consequence, the stresses induce work hardening of the residual metal below the scoring tool which inhibits the metal flow and this can give rise to incipient cracks. Because of these factors it has been found difficult to maintain a scored line with a residual of the consistent depth necessary for the ready tearability of easy open lids particularly when these are made from tinplate.

Problems in maintaining the tooling arise particularly when scoring tinplate because the edge of the scoring tool requires replacing at frequent intervals as it becomes blunted by the impact of the tool on the surface of the tinplate supported by the bottom die.

When using tinplate the scoring process is often not deemed to be satisfactory as the scoring tool cuts through the coating of tin on the sheet metal which gives rise eventually to corrosion. To overcome this problem a coating of lacquer is usually applied to the material, which is an additional expense in manufacture.

It is an object of the present invention to provide sheet material having a weakened line or weakened portion especially sheet metal with a frangible element suitable for use in a container wall. Another object is to provide a method and tooling for making a weakened line in the form of a frangible element in sheet material in such a way that it may overcome or may assist in overcoming the formation of cracks in the residual material. It is a further object to provide a method and tooling which may avoid cutting through the coating of tin in tinplate when making a weakened line.

In accordance with the method of the present invention the frangible element which is made in the sheet material is formed by thinning a portion of the sheet by a pressing operation between press tool dies, thus forming a frangible element between first and second thicker portions of the material. One of the requirements of such a pressing operation is that some suitable provision shall be made for the material displaced between the dies as the sheet is thinned to form the frangible element, thus avoiding the piled-up inclined surfaces referred to earlier in this specification. However for commercial reasons the pressing operation must be done with reasonable speed and as a one-step operation, any sequence of operations involving the successive gradual doformation of the material would be time consuming and comparatively expensive. I have found that excess material from the thinned portion constituting the frangible element can be made to flow sideways if the material to one side of the frangible element is at the same time acted on the form at least one hollow indentation in the material. This forming of the hollow indentation or indentations does not materially increase the thickness of the material, but it does permit a flow of metal towards the indentation or indentations and this is sufficient to cause excess material from the thinned portion of the material to flow sideways into the thicker material on the side having the indentation. Whilst it would be possible to form indentations on both of the said first and second thicker portions, I have found that this is in fact unnecessary.

A further requirement, and this applies particularly to the pressing of tinplate, or other sheet materials having a protective coating layer, is that the pressing operation shall not leave a sharp edge which might cause the substrate below the protection coating to become exposed. Thus the pressing operation is such as to form a rounded step in a surface of the material between the frangible element and one of the adjacent thicker portions of material, which I will call the "first portion". On the other side of the frangible element, i.e. between the frangible element and the second thicker portion of material, there is a rounded formation in a surface of the material which may take the form of a rounded step, preferably a rounded step in the opposite surface of the material from the step joining the frangible element to the first portion, and laterally spaced therefrom. If the second portion of the material has a deformation such as a hollow bead adjoining the frangible element, then the rounded formation may lead directly into the bead, for example, there may be a downward formation leading to a downwardly-formed bead or an upward formation leading to an upwardly-formed bead.

According to one aspect of this invention there is provided a method of making a frangible element in thin sheet material by use of press tool dies comprising compressing the material between the dies and displacing parts of the material to different planes so as to form a step in one surface of the material and spaced therefrom a step in the opposite surface of the material and to form a thinned portion between the steps constituting the frangible element. In the case of sheet metal the method allows the metal from the thinned portion to flow in the dies, and, it is believed, causes or assists in causing the compressive stresses to be equally disposed on each side of the metal and reduction in the work hardening of the metal. Excess material is caused to flow from the region of the thinned portion into a second region to one side thereof where the sheet material is acted on by the dies to form it into the shape of a hollow bead close to the thinned portion.

Preferably the shaping in the second region is commenced before or at least at the same time as the commencement of the pressing to a weakened line so as to initiate the formation in a controlled manner of a shape in the second region which will accommodate the extra length of material produced as a result of excess material being caused to flow from the region of the thinned portion.

It is preferred that both steps shall be downwardly formed and that the bead in the second region be downwardly formed adjacent the downardly formed step in the bottom surface of the sheet metal.

There is further provided according to the invention a method of making a frangible element in sheet metal which comprises pressing between press tool dies a portion of the metal bounding an area of the metal and allowing excess metal to flow from the region of the pressed portion into said area. The metal which is subjected to the pressing operation may be annular in form. The dies produce a deformation, e.g. a hollow bead in the metal, inwardly of the pressed portion before and/or at the same time as the portion is pressed to assist in taking up excess metal from the pressed portion.

In its broadest aspect press tooling according to the present invention includes top and bottom press tool dies having first opposed die parts with a rounded step in one of the dies whereby sheet material pressed between the dies in a single step pressing operation has formed therein a frangible element consisting of thinned material and adjacent the frangible element a rounded step in one surface of the material. The dies are so shaped as to allow, during pressing of the sheet material, excess material to pass into a portion of greater thickness that the frangible element on the other side of the frangible element from the rounded step. The dies also have second opposed die parts which, during the pressing of the material can act upon the material of the said portion without causing substantial variation in the thickness of the material, to form at least one indentation in the material.

The first die parts may include a further step spaced from the said step whereby a further rounded step is formed in the sheet material when the material is pressed between the dies, the frangible element extending between the steps.

The second opposed die parts preferably include a projection in the top die so that as the top die moves towards the bottom die the formation of a downwardly directed indentation in the sheet material is initiated which will enable excess material from the thinned portion to be accommodated. Preferably a recess is provided in the bottom die opposite the projection, which may be in the form of a bead, and the excess material may flow into or towards the deformation, e.g. a hollow bead, made in the sheet, which deformation may become located in the recess. The recess may adjoin one of the first opposed die parts or may be adjacent thereto to assist the flow of excess material away from the thinned portion. The bead or other shape formed in the material may in this case be considered as being adjacent the thinned portion if the distance between the recess and the thinned portion is small.

It is preferred that the thickness of the frangible element produced by the method or apparatus of the invention shall be about one third or even less of the initial thickness of the material.

In the description with reference to the drawings the invention is exemplified as applied to tinplate and it is with this material and other plated materials particularly that the advantages of the invention are obtained. However, the claims are not limited to the use of tinplate as the sheet material, because the invention is applicable to other materials.

Various forms of this invention will be described with reference to the accompanying drawings in which:

FIG. 1 illustrates in part perpective a weakened line made in sheet metal by scoring means of a type employed prior to the present invention;

FIG. 2 illustrates in part cross-section view dies for providing a scored line in sheet metal as shown in FIG. 1;

FIG. 3 illustrates in part perspective view a weakened line or frangible element in sheet metal according to the present invention;

FIG. 4 illustrates in fragmentary cross-section view dies for forming the weakened line or frangible element shown in FIG. 3 in the open position;

FIG. 5 illustrates in fragmentary cross-section view the dies shown in FIG. 4 in the closed position;

FIG. 6 illustrates in fragmentary cross-section view a view similar to that of FIG. 5 showing a recessed top die;

FIG. 7 illustrates in fragmentary cross-section view means for reinforcing a thinned portion;

FIG. 12 illustrates a part cross-section through a sheet metal container having a lid consisting of a sheet metal member such as shown in FIG. 11, the section being taken along one of the lines 170 of FIG. 11;

FIG. 13 illustrates in perspective view a panel of the lid shown in FIG. 12 being removed from the container.

FIG. 14 is a part perspective view showing a weakened line or frangible element in sheet metal with a series of upwardly formed beads; and FIG. 15 is a part cross-section similar to FIG. 14 but showing the series of beads closer to the frangible element.

Figure 8:
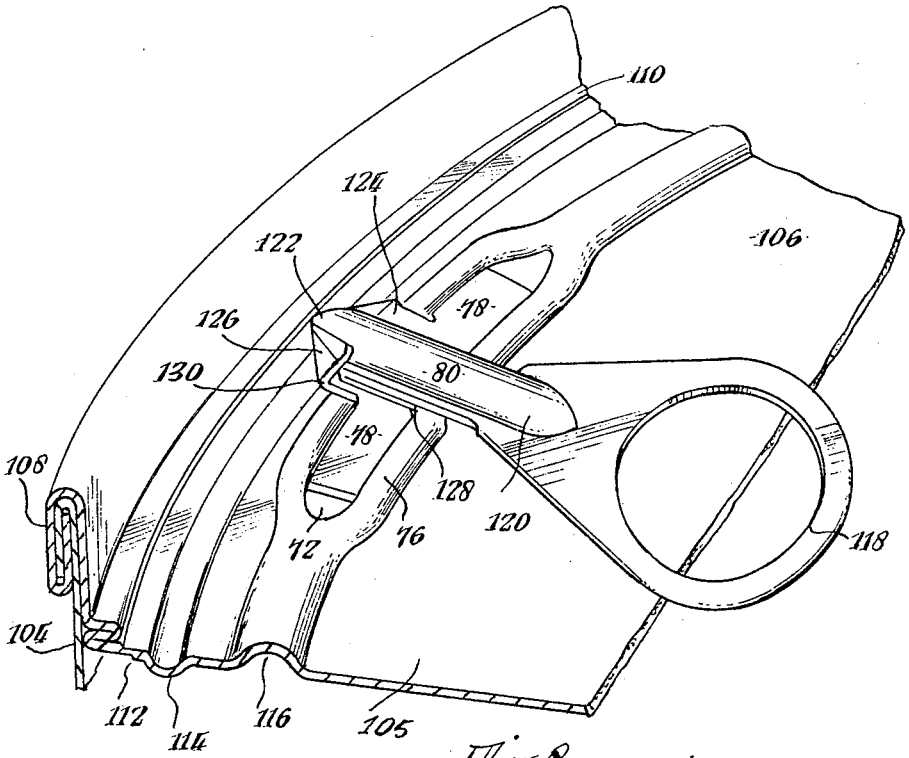
FIG. 8 illustrates in part perspective view a preferred form of opening device for a container lid using a frangible element similar to that shown in FIG. 7.

In FIG. 1 is shown a lid 10 of, for example, a container made of sheet metal having a weakened line 12 made by scoring or partially cutting through the metal in accordance with a previous method.

FIG. 2 illustrates the dies used to make the scored line 12 in FIG. 1. The sheet metal lid 10 is located between a scoring tool 14 and an anvil 16 with the sharp edge 18 of the scoring tool 14 entering into the sheet metal. Penetration of the metal by the scoring force 20 is resisted by compressive stresses 21 in the top portion of the metal. The displaced metal forms inclined surfaces in the top of the metal on each side of the scoring tool resulting in unbalanced stresses between the top and bottom surfaces of the metal so causing failure in the form of cracks, 22.

In FIGS. 3, 4 and 5 there is shown in accordance with the present invention an article and a method and apparatus for making it, the article comprising a sheet metal container wall 26, in this instance a tinplate lid, having a weakened line or frangible element 24. The frangible element 24 bounded by steps forms part of an extrusion in the metal, the formation of which is subsequently described, the extrusion defining a tear-open geometric pattern (surrounding a tear-open panel) and being, in this example, annular in plan. The frangible element 24 is in the form of a thinned portion of the metal constituting an area of thickness smaller than the general, substantially uniform, thickness of the container wall 26, and is elongated inwardly from the peripheral bounds of the geometric pattern, having a controlled cross-section of essentially constant thickness.

In FIGS. 3, 4 and 5 the annular frangible element 24 is made by pressing an annular portion of the metal which with an annular hollow bead 30 bounds a central area 32 of the lid 26. The lid which has a rim 34 before making the weakened line, is shown in open press tool dies in FIG. 4. The dies are made from suitable tool material and they comprise a top die 36 and a bottom die 40. The dies 36 and 40 are generally circular. A part of the left-hand side only of the dies is shown in FIGS. 4 and 5 along a radial section line. The shape towards the centre of the dies may be modified as shown in FIG. 7 subsequently described.

Top die 36 has a flat surface 42 comprising two concentric areas 42*a*, 42*b* separated by a projection in the form of a bead 47. The top die has a raised stepped edge portion 44 including a step 46 and a flat surface 48. The step 46 has rounded edges 49, 49' where it joins the surfaces 42*b*, 48. A step joining surfaces through curved or rounded edges in dies or sheet material is referred to in this description and the claims as a rounded step. Such steps between the curved or rounded edges may be perpendicular to the surfaces they join or inclined to one or both of them. Surfaces 48 and 42*b* which are parallel comprise respectively top and bottom work-contacting surface for the top die separated by the rounded step 46 and surrounding a central area of the die.

Bottom die 40 comprises a rim portion 50 and a flat portion 52 constituting a work-contacting surface which extends inwardly of rim portion 50 to an edge or step 56 from where on the bottom die is relieved to allow downward displacement of the sheet material. In detail, adjacent flat portion 52 is provided a stepped portion 54 and a recess 60. The stepped portion 54 comprises a rounded step 56 and a ledge 58 underlying the flat surface 42*b* of top die 36. Step 56 joins surfaces 52, 58 through rounded edges 59; 59'. Ledge 58 comprises a further (bottom) work-contacting surface for the bottom die separated by the step 56 from the (top) work-contacting surface 52 and with it surrounding a central area of the bottom die. Flat portion 52 and ledge 58 are parallel to each other and to surfaces 48 and 42*b*. Adjacent to the ledge 58 of stepped portion 54 is provided the recess 60. It will be observed that the bead 47 of the top die is opposite the recess 60, i.e. at a position to register with the recess for the purpose subsequently explained. It should be understood that the designations "top" and "bottom" in relation to the dies described and claimed herein are not intended to indicate that one die will always be used vertically above the other. Any suitable orientation of the dies may be used. The designations top and bottom in relation to the surfaces of the sheet metal should be similarly understood.

Referring to FIG. 4, as the top die 36 moves towards the bottom die, the bead 47 initiates a deformation in the sheet metal in the shape of a shallow curve at the point where the bead impinges on the metal. Subsequently as the dies close further, (FIG. 5) the top die 36 co-operates with the bottom die 40 to complete the formation of the substantially part-circular bead 30 from this deformation and to displace parts of the sheet metal to different planes and to form a thinned portion 24 or frangible element between work-contacting surfaces 42*b* and 52. It will be seen that a part of the top surface of the material is displaced by the dies towards an opposite side of the sheet and a part of the bottom surface of the sheet is displaced in the same direction. Edges 64, 66 of the two displaced parts are separated with the thinned portion 24 in between. A downward formation in the shape of a rounded step 64 is produced in the top surface of the sheet leading from a first portion 65 of the sheet to the thinned portion 24 which is in a plane parallel to the first portion 65 and of smaller thickness than the said portion. A downward formation or depression in the shape of a round step 66 is also formed in the bottom surface of the sheet leading from the thinned portion to a second portion 67 of thickness greater than the thinned portion. Steps 64 and 66 are formed in the same direction and are spaced from each other with the frangible element 24 between them. These steps correspond to the step 46 in the top die and the step or edge 56 in the bottom die, which, as shown, are spaced apart in the closed position of the dies.

In the pressing operation, the bead 47 of top die 36 presses the sheet metal of the lid 26 into recess 60 of bottom die 40, drawing metal down into the recess while a portion of flat surface 42*b* of top die 36 compresses and thins the sheet metal against the flat portion 52 of bottom die 40 over the area of overlap between these two work-contacting surfaces. The respective portions of the work-contacting surfaces 42*b*, 52 at the said area of overlap constitute mutually opposed narrow elongate surfaces in the respective dies, and it is these elongate surfaces which form the elongate frangible element 24 in the sheet. The thinned area comprisees the weakened line or frangible element 24 its edges being defined by steps 64 and 66. Step 66 lies inwardly of step 64 substantially parallel thereto. The width of the frangible element 24 is substantially constant and is greater than its thickness. The steps are annular in form as is the frangible element. The formation of the thinned portion 24 and the bead 30 may be considered as an inward extrusion of the material between the dies, the final shape of which is controlled by the shape of the dies. The inward movement of the material is facilitated by the rounded edges 49, 49', 59, 59' of the steps in the dies which assist and control the flow of the material. This flow of material and the means for producing it are quite different from scoring as above described and are also quite different from semi-shearing in which metal is partially cut through or sheared by use of sharp cornered tools, which moreover do not compress a portion of metal to thin it.

Referring to FIG. 3, the metal sheet in the region of the extrusion is seen to have on the top surface first and second surface elements *a* and *b* in different planes joined by a step 64 (corresponding to the top die surfaces) and a curved surface element *c* adjacent the second said element directed away from the plane of the first element *a*. On the bottom surface the metal sheet has (corresponding to flat portion 52 of the bottom die) a plane surface element *d* opposite the first surface element *a* and the step 64 and also opposite at least part of the second surface element *b* and a curved surface *e* opposite and substantially parallel to the curved surface *c* on the top surface of the sheet, the distance between the first surface element *a* and the plane surface element *d* exceeding the distance between the second surface element *b* and the plane surface element *d*. The plane surface element *d* joins the lower curved surface *e* by a step 66 directed away from the plane of the second surface element *b*, and a ledge *f*. Drawing the sheet metal to form bead 30 from the area of the frangible element 24 assists in accommodating the excess metal which freely flows inwardly in the dies from the thinned area to produce a deformation in the lid in a controlled manner. If the deformation was not initiated by the projection in the die 36, there would be a danger of it taking place at random across the lid producing undesired buckling. The thickness of the metal in the area of the bead 30 between the curves *c* and *e* remains substantially the same during the process of deformation.

The rounded step 64 and the portion of surface element *d* immediately opposite the step 64 through the sheet constitute a pair of mutually diverging opposite surfaces (one in each sheet surface) and define an element in the metal of the sheet which joins the thinned metal of the frangible element 24 to the adjacent unthinned region of the sheet. Similarly at the other side of the frangible element 24 there is an element joining the frangible element to the adjacent unthinned region and having a pair of mutually diverging opposite surfaces constituted by the rounded step 66 and the portion of surface element *b* immediately opposite the step 66 through the sheet. In each of the said pairs of diverging opposite surfaces, one of the surfaces (i.e. the step 64 in one case and the step 66 in the other) is curved in section so as to merge smoothly by a concave curve into surface of the frangible element.

By forming an identical step in each surface of the sheet (i.e. the steps 64, 66 in the respective surfaces), it is achieved that the two surfaces of the thinned region are each increased in length by a substantially equal amount as seen in cross-section across the thinned region. Consequently while it is not desired to be bound by theory it is believed that the compression stresses 68 (FIG. 5) are equally balanced between the top and bottom surfaces of the sheet metal so that displaced metal can flow in equilibrium between the dies into the bead 30 without any or with reduced risk of work hardening the thinned metal so avoiding or reducing the risk of cracking. The method and apparatus facilitate the production of a consistently accurate depth of residual material in the lid or other container wall which ensures that this can always be readily and easily opened by the user by use of suitable means, e.g. as subsequently described. The residual thickness is preferably less than half the general lid thickness. For tinplate lids 0.009 ins. thick the residual material is preferably approximately one third this thickness, i.e. 0.003 ins. thick. The residual depth can be varied according to the characteristics of the material.

Repeatable accuracy of depth of the frangible element is obtained over very large production runs as the flat work-contacting surfaces maintain their shape and form. This overcomes the disadvantage arising from prior art scoring processes where constant impact of the scoring tool on the anvil causes the tool to become blunt.

In a modification of the dies shown in FIGS. 3 to 5, the stop 56, rounded at 59, leads downwardly directly into a recess similar to recess 60, the work-contacting surface 58 being omitted. A stop similar to step 64 is thereby formed in the upper surface of the sheet material while on the bottom surface, a depression is formed in the recess adjoining the thinned portion or frangible element. This depression provides the lower surface of a bead which is formed in the recess by a co-operating bead in the top die.

Referring now to FIG. 6 there is shown a section through dies and a lid generally similar to the dies shown in section in FIG. 5, like parts being indicated by like numerals. The section is taken along a line where upstanding triangular shaped ears 70 for use subsequently as securing means have been formed in the central area 32 of the lid 26 prior to its entry into dies 36, 40. The triangular shaped ears extend generally parallel to the rim 34 of the lid 26 preferably along an arcuate line inwardly of and parallel to a part of the circumference of the lid. The ears have a channel 72 between them which is intended to receive fixing tabs of a handle used in opening means for the container. A recess 74 in top die 36 provides a clearance right round the lid to clear channel 72 and a bead similar to bead 116 subsequently described with relation to FIG. 8.

In the present example it is convenient to form the ears 70 in the blank prior to making the frangible element to avoid breaking the element in a subsequent forming operation. The ears may be used to make a folded connection 76 described later in relation to FIG. 8 by placing tabs 78 of an opening device 80 into the channel 72 and bending down the ears over the tabs while holding the remainder of the lid in suitable clamps.

In FIG. 7 is shown a form of reinforcement for a can end made, for example, of tinplate formed adjacent a thinned weakened portion or frangible element 98. A lid 84 has in the base of its rim 86 a reinforced edge 88 comprising two layers of material overlying the material 89 adjacent the thinned portion 98, the layers being joined to each other and to the material 89 through reversed bends 90 and 92. Bend 90 provides adjacent one of the rounded steps 96 which bounds the thinned portion a shoulder 94 against which can be broken an edge 97 of the thinned portion. Shoulder 94 also provides a safe edge for the inside of the container when the removable portion 100 of the lid has been removed. A bead 102 is provided as previously explained.

In FIG. 8 is shown a preferred form of opening device for opening a lid of a container. A handle 118 is secured to a tear open portion 105 of the lid 106 bounded by a frangible element 112 whereby the frangible element may be ruptured and the tear open portion lifted from the wall. In the figure, a container body 104, a lid 106 and an opening device 80 are all preferably made from tinplate although other materials such as aluminum can equally well be used. Lid 106 is joined to body 104 by a seamed joint 108. Use of tinplate for both body and lid is advantageous from the point of view of cost. Lid 106 is provided with a reinforced shoulder 110 similar to shoulder 94 above described and a thinned portion or weakened line 112 to provide a frangible element which is formed in a manner similar to that above described. A folded connection 76 provided in the material (see also FIG. 6) secures tabs 78 of the opening device 80 to the lid. The folded connection may be made by clenching downwardly triangular shaped ears formed in the blank prior to pressing the weakened line as above described with reference to FIG. 6. The lid has an annular bead 114 similar to the beads 30 and 102 previously described in relation to FIGS. 3 and 7, and a stiffening bead 116.

The opening device 80 comprises a tab handle 118 including a ring and a stiffening bead 120 provided with a nose portion integrally connected to tabs 78 by a hinge portion 124. In the initial inoperative position of the tab handle in which it lies substantially parallel to that of the lid, the nose portion 122 is located above and inwardly of the thinned portion or frangible element 112 spanning the bead 114. The nose portion 122 is reinforced by folding corners 126 over hinge portion 124 as shown in FIG. 8. Slits 128 one each side of bead 120 allow bead 120 to be lifted by handle 118 so that the hinging can take place and the overlying corners 126 serve to prevent tearing of the metal along the lines of slits 128 beyond the edges 130 as the handle 118 is lifted. The reinforcement which the corners 126 provide does not increase the overall height of the opening device and therefore allows the container lids with their opening devices to be nested prior to assembly on container bodies.

Figure 9:
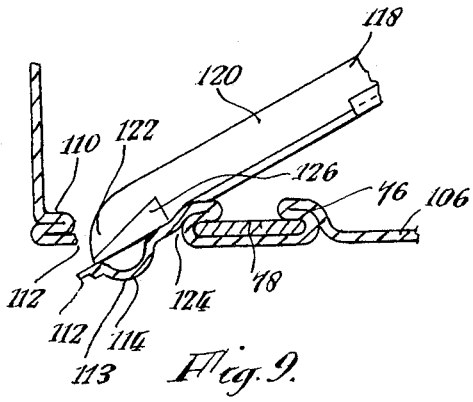
FIG. 9 illustrates in fragmentary cross-section view the container lid shown in FIG. 8 being opened.

In FIG. 9 the handle 118 is shown lifted to its operative position with nose portion 122 hinging downwardly an breaking through or puncturing a portion of the frangible element 112 so as to bend down an underlying portion 113 of the lid. The handle with its securing means is then upwardly pulled out of the original plane of the lid to fracture through on each side of the initial puncture the remainder of the frangible element 112 against the shoulder 110 so lifting and removing the portion 105 of the lid inwardly of the element 112 from the container. In tinplate, the lid is preferably so constructed that as the removable portion is lifted by the handle the shearing of the remainder of the frangible element on each side of the original puncture point proceeds with a minimum amount of bending of the removable portion taking place. It will be understood that this preferred process is different from the action in tear-off containers previously proposed in which a scored line is progressively torn through to peel off from the container a removable portion of the lid which bends appreciably in the process.

In opening means using a frangible element made by the means herein described, a handle may be secured to a removable portion of the container wall by means other than those above described, e.g. by riveting, welding or other securing means.

Figure 10:
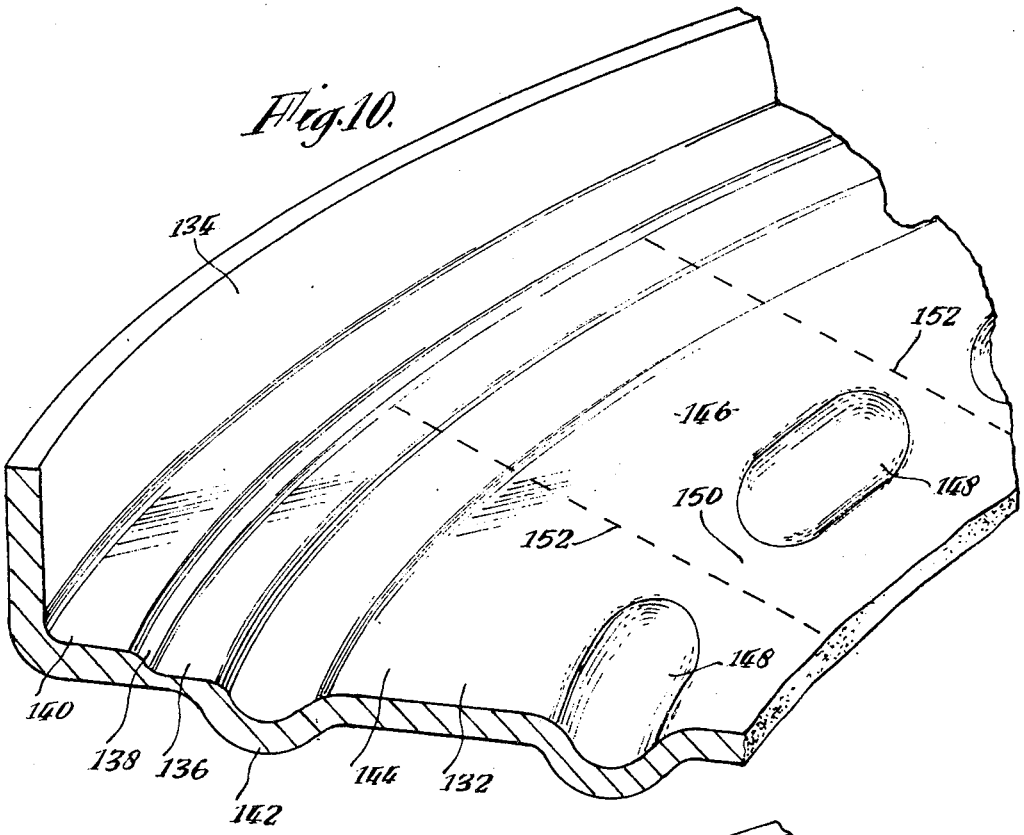
FIG. 10 illustrates in part perspective view a weakened line or frangible element in sheet metal according to the present invention with intermittent beads adjacent to a first bead.

In FIG. 10 there is shown a sheet container wall 132 made of tinplate having a rim portion 134 and weakened line or frangible element 136. The frangible element 136 is bounded on one side by an upward formation in the form of a step 138 leading to a first portion 140 of the container wall and on the other side by a downward formation in the other surface of the metal leading to a second portion 144, the downward formation being in the form of the under surface of a hollow bead 142. The frangible element 136 defines a tear-open geometric pattern surrounding a tear-open panel 146 and is in this example annular in plan. The frangible element 136 is in the form of a thinned portion of the metal constituting an area of thickness smaller than the general, substantially uniform thickness of the container wall 132 and is elongated inwardly from the peripheral bounds of the geometric pattern represented by the step 138, having a controlled section of constant thickness.

The annular frangible element 136 is bounded on the inward side by the bead 142 or some such similar shape. The bead is downwardly formed in the present example but a bead or similar shape may be upwardly formed in other examples. The bead or other shape is so dimensioned that its configuration takes up the excess metal which flows from the frangible element 136 when the metal is thinned to form the weakened line in suitable press forming dies.

Close to the bead 142 is provided in the tear-open panel 146 a series of downwardly directed bead formations or indentations 146 with a space providing flat portions 150 between the extremities of the beads 148. Alternatively the beads 148 may be upwardly formed. The beads 148 may be suitably spaced all round the tear-open panel or partly round it adjacent to an opening device e.g. in the form of a handle (not shown) for removing said tear-open panel 146.

The beads 148 are formed at the same time as the bead 142 and the formation of the beads by a pressing operation is preferably initiated before the pressing of the element 136 and is continued at the same time as this element is thinned. It has been found that, when this the illustrated sheet container wall is formed by a pressing operating in this way, the element 136 can be brought to its thinned-out condition shown without any production of cracks and without any rupture of the tin surface.

The purpose of the beads 148 apart from assisting to take up excess metal from the thinned portion is to provide control means for assisting the removal of the tear-open panel to avoid content, especially any liquid contents of the container, from spilling, as can happen when a tear-open panel is too quickly removed. Beads 148 intermittently stiffen the parts of the panel so that when said panel is torn out of the container by fracturing frangible element 136 the surface of the panel bends slightly in a series of hinge-like movements across flat portions 150 along bend lines (shown by dotted lines 152) extending across the panel between successive pairs of beads on either side of the panel. The beads 148 provide the desired control without increasing the depth of the lid which is an important factor from the viewpoint of mass production techniques.

The thickness of the metal may be reduced to less than one half in making the frangible element 156. In tinplate the residual thickness may conveniently be about one third the original thickness of the sheet. By way of example only, for tinplate of thickness 0.009 in. the depth of the residual metal in the frangible element may be 0.003 ins. and the width of the frangible element may be 0.002 ins., the width of metal as a whole which has been thinned to below the original thickness being, because of the sloping nature of the upward and downward formations 138 and 142 on either side of the frangible element, of a width greater than the width and also greater than the thickness of the frangible element. The curves joining the frangible element to the upward and downward formations in this example may be of 0.004 ins. radius.

Figure 11:
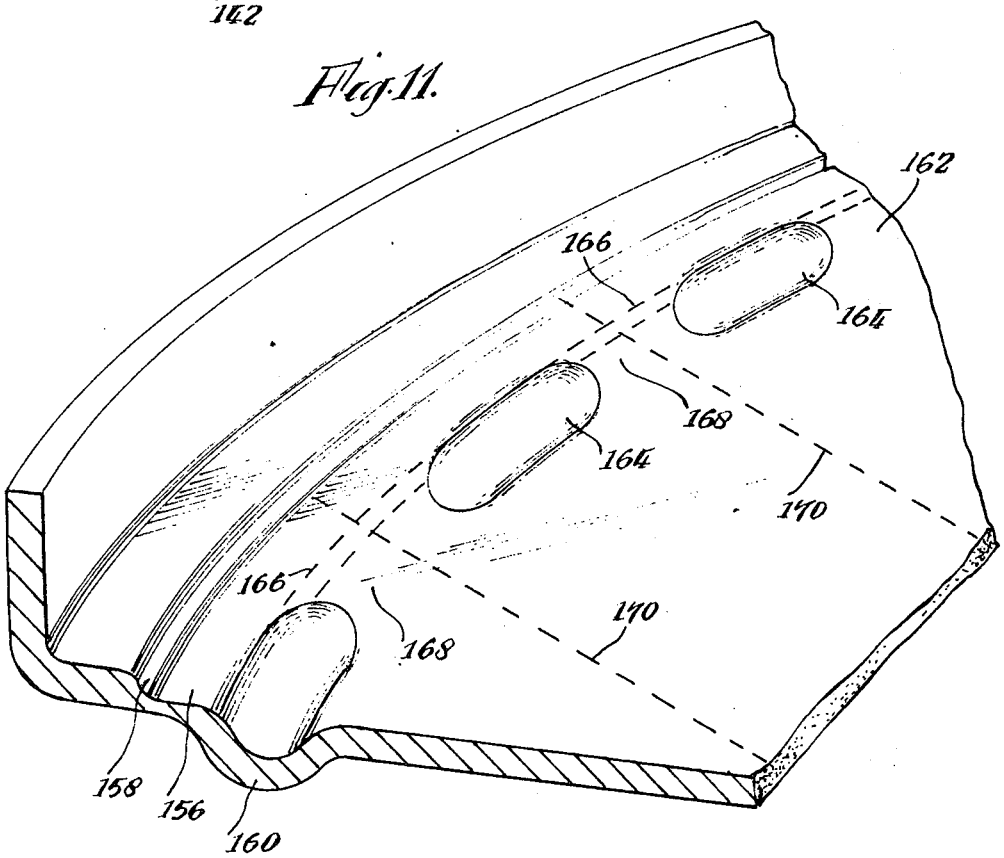
FIG. 11 illustrates in part perspective view a weakened line or frangible element in sheet metal with a series of intermittent beads adjacent to the frangible element.

FIG. 11 shows alternative means for controlling the rate of opening of a tear-open panel. A sheet container wall 154 made of tinplate having a rim portion 157 is provided with a weakened line or frangible element 156. The frangible element 156 is bounded by an upward formation in the form of a step 158 on one side and by a downward formation 160 in the opposite surface of the metal on the other side and forms part of an extrusion in the metal defining a tear-open panel 162. The frangible element 156 is in the form of a thinned annular portion of the metal constituting an area of thickness smaller than the general, substantially uniform thickness of the container wall 154 and is elongated inwardly from the peripheral bounds 158 of the frangible element 156 having a controlled section of constant thickness.

The downward formation 160 is constituted by a series of downwardly directed separate beads or indentations 164 or some such similar shapes and by separate step formations 166 in the underside of the metal linking the beads 164. The beads are so dimensioned that their configurations take up the excess metal which flows from the frangible element 156 when this is made in suitable press forming dies. Spaces 168 lie between the extremities of the bead formations 164. Beads may be formed all round the periphery of tear-open panel 162 adjacent to frangible element 156 or may be formed partly round it. Instead of being downwardly directed, the beads 164 can in an alternative example be upwardly formed.

When the tear-open panel is removed from the container by fracturing the frangible element 156 the surface of the panel bends slightly in a series of hinge-like movements across flat portions 168 along bend lines 170 (shown by dotted lines). In this manner the removing of tear-open panel is controlled by the successive bending at the bend lines 170 which avoids the risk of spilling the contents of the containers when these hold liquids or powders.

FIG. 12 shows a part cross-section through a sheet metal container which has been fitted with a lid consisting of a sheet metal member of the type illustrated in FIG. 11, the section being taken along one of the lines 170 of that figure. In order to fit the lid on the cylindrical wall 172 of the container the rim portion 157 of the lid has been folded into the top of the wall 172 forming a bead 174 at the top of the container.

A tab handle 176, shown in FIG. 13, has been riveted to the lid by means of a conventional boss type rivet 180 or by other suitable attachment means. The tab handle 176 is made of tinplate or other suitable material and has a nose portion 178 and a ring handle 182. To open the container the tab handle is lifted towards the rim of the lid causing nose portion 178 to penetrate the frangible element 156, breaking through this for a short distance each side of the nose portion 178 and bending a portion of the lid locally downwards into the container.

The tab handle 176 is next pulled upwardly, fracturing the frangible element 156 further round its periphery. As the tear-open panel 162 within the element 156 is being removed from the container its surface bends slightly in a series of hinge-like movements round bend lines 170 which form in the panel between successive pairs of beads 164 on opposite sides of the handle as seen in FIG. 13. In this manner the removal of tear-open panel 162 from the container is controlled by the successive bending at the bend lines 170 which avoids the risk of spilling the contents as can happen when lids of known design are pulled from a container.

In FIG. 14 the sheet container wall 188 has a weakened line or frangible element 190, annular in plan, bounded on its outer side by an upward formation 192 and on its inner side by an upward formation 194. A series of upwardly formed beads 196 is located within the frangible element 190. These beads 196 are further from the frangible element 190 than are the beads in FIGS. 10 and 11, but are nevertheless close enough to allow flow of metal inwardly during formation of the frangible element, the beads being formed simultaneously therewith. The beads 196 have exactly the same function as those of FIGS. 10 and 11, that is to say, when the tear-open panel is torn out of the container, the surface of the panel bends slightly along bend lines 198.

FIG. 15 is a cross-section of the same container wall but showing the beads 196 in a position so closely adjacent the frangible element 190 that the upward formation 194, where it lies opposite a bead 196, leads directly into the outer surface of the bead in an exactly analogous manner to FIG. 11, except that the beads are upwards instead of downwards.

The series of beads in both arrangements is if necessary interrupted adjacent the tab handle or any other attached opening means employed for a sufficient distance to prevent any bead interfering with the due opening of the container.

It will be appreciated that the series of upwardly formed beads 196 shown in FIGS. 14 and 15 may be replaced by a single upwardly directed bead, equivalent to the bead 142 of FIG. 10 except that it has been upwardly instead of downwardly formed. FIG. 15 may equally be regarded as a cross-section through such a single upwardly formed bead.

Thinned portions in accordance with this invention may be made to completely surround the lid or wall of a container or a portion thereof in the form of a circle or other suitable closed figure, or, if desired, may only partly surround part or the whole of a lid which can then be bent away from or into the container after fracturing the thinned portion.

The fracturing need not be carried out by handle means and the method and apparatus of this invention are intended for use in the manufacture generally of frangible elements in container walls however these may be utilised.

What is claimed is:

1. Press tooling for forming a frangible element in sheet metal including two press tool dies which have mutually opposed narrow elongate surfaces in the respective dies which opposed surfaces are adapted to engage and squeeze a line in sheet metal lying between the dies when the dies are closed together to form a frangible element in the sheet metal along the said line, a part of each die extending adjacent to and recessed relative to the said opposed surface in that die, the two said recessed parts being respectively on opposite sides of the opposed surfaces, a surface in each die joining the said recessed part of that die to the said opposed surface of that die and being curved in cross-section so as to merge smoothly with a convex curve into the said opposed surface of that die, the two said curved surfaces being spaced apart and the frangible element extending between them in the closed position of the dies, and at least one means for forming a hollow deformation in the sheet to one side of the said line, said means comprising a projection in one die to one side of the said opposed surface in that die and a recess in the other die opposed to the projection, the projection and recess being adapted to co-operate to form the said hollow deformation in the sheet metal during closure of the dies, thereby to take up excess metal from the line extruded past one of the said curved surface in the dies.

2. Press tooling according to claim 1 wherein the said recess opposed to the said projection is one of the said parts recessed relative to the opposed surfaces.

3. Press tooling according to claim 1 wherein the said projection stands proud of the said opposed surface in the same die whereby the dies engage sheet metal to initiate formation of the said hollow deformation before they begin to squeeze the said line.

4. Press tooling according to claim 1 wherein the said opposed surfaces are parallel to each other and are planar and each respectively is flush with an adjacent surface of the same die which engages a part of the sheet metal whose thickness is substantially unaltered in the pressing operation.

5. Press tooling according to claim 1 wherein the said projection is an elongate rounded bead close to the said opposed surfaces.

6. Press tooling according to claim 1 wherein the said opposed surfaces are both continuous and surround areas of the respective dies in which the said projection and recess are located.

7. A method of forming a frangible element in metal sheet having two surfaces and on at least one of the said surfaces a thin outer layer of surfacing material, including thinning a line in the sheet by means of press tool dies to form the frangible element and simultaneously forming at least one hollow deformation in the sheet to one side of the said line, wherein in the said thinning operation the dies shape two elements of the sheet one at each side of the line each of which has in section mutually diverging opposite surfaces (being respectively parts of the two sheet surfaces), the said frangible element extending between the said elements and being joined by them to the remainder of the sheet, one of the said diverging opposite surfaces of each of the said elements being formed so that in section it is curved so as to merge smoothly with a concave curve into a surface of the frangible element, the two said curved surfaces being respectively parts of the two sheet surfaces of the sheet and diverging in opposed directions from the frangible element, whereby excess metal squeezed from the thinned line in the thinning operation is extruded away from the line towards the said at least one hollow deformation.

8. A method according to claim 7 including initiating the formation of said at least one hollow deformation before beginning the said thinning operation.

9. A method according to claim 8 wherein the said press tool dies performing the thinning operation also form the said at least one hollow deformation.

10. A method according to claim 7 wherein the said line is continuous in plan and wherein the said at least one hollow deformation is in plan within the line.

11. A method according to claim 7 including leaving unaltered the thickness of all parts of the metal sheet, including the part where the said at least one hollow deformation is formed, except the part where the said line is thinned.

12. A method according to claim 7 wherein the thickness of the frangible element after thinning is about one-third of the thickness of unthinned parts of the sheet.

13. Method of forming an elongate frangible element in metal sheet having two surfaces comprising a. operating on the sheet with press tool dies to thin a line in the sheet by extruding excess metal from the thinned line to one side of the line, the dies forming in the region of the thinned line only rounded (in section) transitions in the surfaces of the sheet, and the two surfaces of the sheet in the region of the thinned line each being increased in length as seen in cross-section by a substantially similar amount by the dies in a manner such that inequalities in compressive stress as between the two surfaces are substantially avoided, and simultaneously, b. forming at least one hollow deformation in the sheet to the said one side of the line to take up the said extruded excess metal.

14. Method according to claim 13 wherein two said rounded transitions are formed by the dies, one in each surface, the thinned line lying between them and being joined by them to adjacent parts of the sheet whose thickness is unaltered.

15. Press tool dies for forming a continuous elongate frangible element of thinned metal bounding a tear-open portion in metal sheet including:

a. first co-operating die parts constituted by a top die part and a bottom die part; the top die part having a work-contacting surface comprising a flat portion and a relief portion which is curved as seen in cross-section and extends longitudinally continuously in the top die part at a radially outer edge of the said flat portion of the top die part; the bottom die part having a work-contacting surface comprising a flat portion and a relief portion which is curved as seen in cross-section and extends longitudinally continuously in the die part at a radially inner edge of the said flat portion of the bottom die part; in the closed position of the said first die parts, the said working-contacting surface of the top die part at least partly overlying the said work-contacting surface of the second die part, with the said flat portions lying in parallel planes which are spaced apart by less than the thickness of the metal sheet, and said curved relief portions being respectively curved away from the work-engaging surface of the other die part, whereby the said work-contacting surfaces are adapted when the first die parts close on metal sheet lying between them, to displace portions of the sheet into different planes and to form a continuous elongate region of thinned metal at the junction of the two said sheet portions, the radial limits of said region of thinned metal being determined by the relative radial location of the two said relief portions of the dies, b. second co-operating die parts which comprise a projection and a recess adapted to co-operate with the projection on closure of said second die parts on the metal sheet to form an elongate hollow bead in the metal sheet radially within the said region of thinned metal.

16. Method of forming a frangible line in metal sheet including the following steps:

a. operating on the sheet with two co-operating dies which engage the respective surfaces of the sheet so as to displace a first portion of the sheet in a direction transversely of the sheet with respect to an adjacent second portion of the sheet, a step being formed in each surface of the sheet at the junction of the first and second portions of the sheet, each die having for this purpose a work-contacting surface which includes a relief feature which forms one of the said steps, the two said work-contacting surfaces having a region of mutual overlap and co-operating in the region of overlap to squeeze and thin a line in the sheet at the said junction of the sheet portions, the thinned line lying between the two said relief features so that the relief features are respectively on opposite sides of a line drawn generally transversely of the sheet through a central portion of the thinned line, each of the said relief features comprising as seen in section a surface which curves away from the other die;

b. deforming the sheet in order to take up excess metal and to relieve compressive stress in the region of the thinned line by forming a hollow depression in the sheet to one side of the thinned line without substantially altering the thickness of the sheet.

* * * * *

UNITED STATES PATENT AND TRADEMARK OFFICE

CERTIFICATE OF CORRECTION

PATENT NO. : 3,951,084

DATED : April 20, 1976

INVENTOR(S) : William Cookson

It is certified that error appears in the above-identified patent and that said Letters Patent are hereby corrected as shown below:

Column 2, line 10, change "doformation" to --deformation--, line 15, change "the" (second occurrence) to --to--; column 3, line 9, change "downardly" to --downwardly--; column 4, line 8, change "perpective" to --perspective--; column 5, line 41, change "surface" to --surfaces--, line 68, change "top and bottom" to --"top" and "bottom"--; column 6, line 24, change "round" to --rounded--, lines 45-46, change "comprisees" to --comprises--; column 8, line 6, change "stop" to --step--, line 8, change "stop" to --step--; column 9, line 31, change "an" to --and--; column 10, line 17, change "146" to --148--, line 37, change "content," to --contents,--; column 13, line 10, change "surface" to --surfaces--.

Signed and Sealed this

Twentieth Day of July 1976

[SEAL]

*Attest:*

RUTH C. MASON
*Attesting Officer*

C. MARSHALL DANN
*Commissioner of Patents and Trademarks*